US009047852B2

(12) United States Patent
Canavan

(10) Patent No.: US 9,047,852 B2
(45) Date of Patent: Jun. 2, 2015

(54) POLE POSITION SLIDING PICKUP SYSTEM

(71) Applicant: Michael John Canavan, Bethel, CT (US)

(72) Inventor: Michael John Canavan, Bethel, CT (US)

( * ) Notice: Subject to any disclaimer, the term of this patent is extended or adjusted under 35 U.S.C. 154(b) by 80 days.

(21) Appl. No.: 13/932,303

(22) Filed: Jul. 1, 2013

(65) Prior Publication Data

US 2015/0000508 A1 Jan. 1, 2015

(51) Int. Cl.
*G10H 3/14* (2006.01)
*G10H 3/12* (2006.01)

(52) U.S. Cl.
CPC ..... *G10H 3/12* (2013.01); *G10H 2220/465* (2013.01)

(58) Field of Classification Search
CPC ..... G10H 3/183
USPC ..... 84/727
See application file for complete search history.

(56) References Cited

U.S. PATENT DOCUMENTS

| | | | | | |
|---|---|---|---|---|---|
| 2,964,985 | A * | 12/1960 | Webster | 84/723 |
| 3,911,777 | A * | 10/1975 | Rendell | 84/743 |
| 4,616,548 | A * | 10/1986 | Anderson | 84/743 |
| 5,072,646 | A * | 12/1991 | Valkama | 84/726 |
| 6,043,422 | A * | 3/2000 | Chapman | 84/723 |
| 6,051,773 | A * | 4/2000 | Rose | 84/743 |
| 6,162,984 | A * | 12/2000 | Engard | 84/743 |
| 6,992,243 | B2 * | 1/2006 | Small | 84/267 |
| 7,060,888 | B2 * | 6/2006 | Spalt | 84/727 |
| 7,145,063 | B2 * | 12/2006 | Redard | 84/267 |
| 7,838,758 | B2 * | 11/2010 | Van Ekstrom | 84/743 |
| 8,283,552 | B2 * | 10/2012 | van Ekstrom | 84/743 |

* cited by examiner

*Primary Examiner* — Jeffrey Donels

(57) ABSTRACT

The Pole Position Sliding Pickup System changes the way tonal variety is arrived at by electric guitar players. Rather than installing multiple pickups in different positions in order to achieve a limited variety in tone, the Pole Position Sliding Pickup System uses a single pickup which can be moved quickly and easily to any position between the base of the neck and the bridge in order to achieve a much greater variety in tone, and create wah wah-like sound effects by manipulating the pickup at different speeds and distances. Not only are the variety of possible tones increased, but so is the ease with which they can be attained, because the method of sliding the pickup into place is easier than conventional methods of choosing stationary pickups.

4 Claims, 2 Drawing Sheets

POLE POSITION SLIDING PICKUP SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Figure 1:
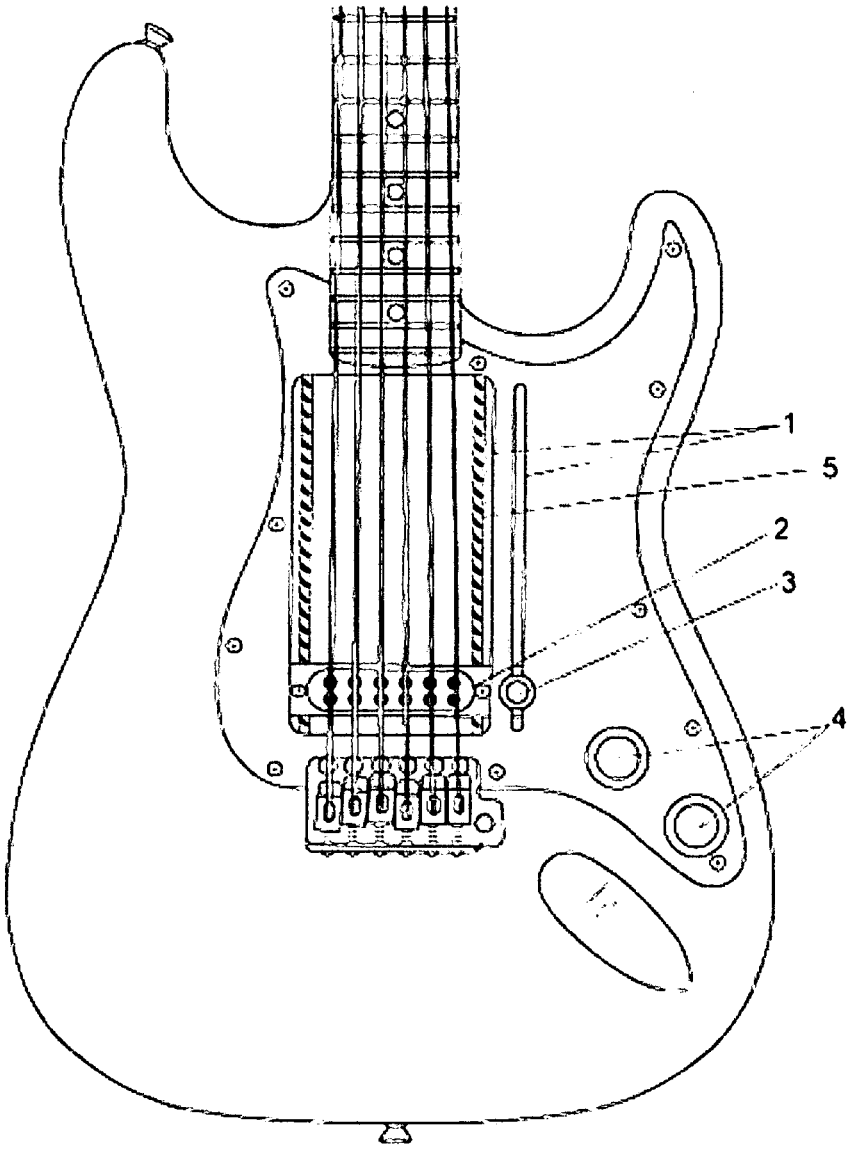

The Pole Position Sliding Pickup System is relevant to the field of musical instruments, in particular the electric guitar. It is relevant both to live performance and to recording in providing increased tonal variety from electric guitars.

BRIEF SUMMARY OF THE INVENTION

The Pole Position Sliding Pickup System allows an electric guitar player to get more tonal variety from his/her instrument than is currently possible by allowing the instrument's pickup to be easily positioned in numerous positions, and changed as often as desired. This is a complete change from the current system of fixed-position pickups which can only offer a set number of tonal options based on where the pickups are affixed to the guitar body.

BRIEF DESCRIPTION OF THE SEVERAL VIEWS OF THE DRAWING(S)

FIG. 1 illustrates the parallel holes in the pickguard (1) that extend from the base of the neck to the bridge and enable the slider handle (3) to be pushed up and down on a fixed path, thereby moving the pickup (2) along the rails (5) and placing it in any desired position. FIG. 1 also illustrates that there is a need for only one volume control and one tone control (4) since there is only one pickup. FIG. 1 shows the slider handle (3) and the pickup (2) in the lowest position on the fixed path, by the bridge, where it would have the brightest sound (most treble).

Figure 2:
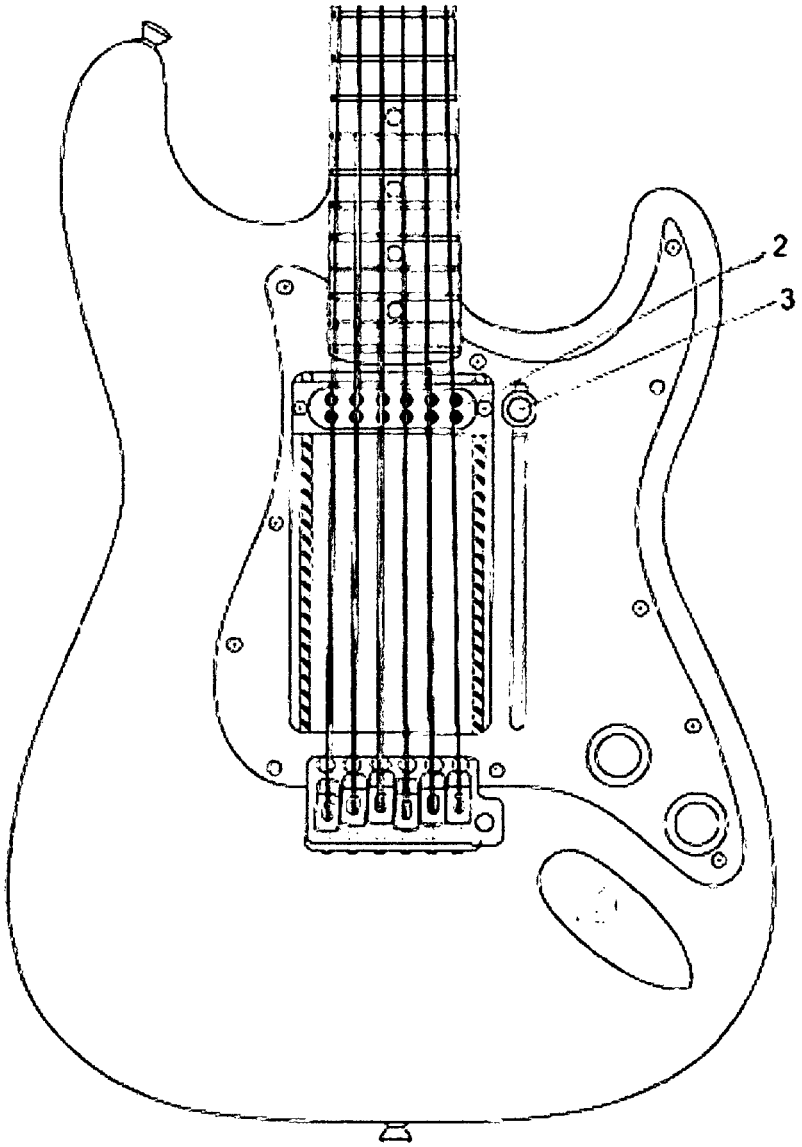

FIG. 2 shows the slider handle (3) and the pickup (2) having been pushed up to the highest position on the fixed path, by the base of the neck, where it would have the dullest sound (most bass).

DETAILED DESCRIPTION OF THE INVENTION

FIG. 1/2 (1) shows the elongated opening in the guitar's plastic pickguard that allows movement of the pickup (2) from the base of the neck to the top of the bridge, and the parallel channel for the guitar's slider knob to move the same distance as it manipulates the pickup in order to achieve more tonal possibilities than a standard two- or three-pickup design.

FIG. 1/2 (2) shows the single pickup in its resting position by the guitar's bridge, perpendicular to the strings, from where it can me moved freely along the length of the pickguard to it's extended position below the neck to produce a variety of tonal possibilities.

FIG. 1/2 (3) shows the slider handle that a player can manipulate with a single finger in order to move the pickup along the length of the pickguard while continuing to play the guitar and generate interesting wah wah like-sound effects by gently pushing the slider in either direction at any speed, as opposed to adjustable pickup systems which can only be changed when a guitar is not being played.

FIG. 1/2 (4) shows the single volume and optional tone knobs, used to control the volume and tone of the pickup.

FIG. 1/2 (5) shows the metal rails that the pickup will slide along as it moves between the bridge and neck positions.

FIG. 2/2 (2,3) shows the pickup and slider handle in the extended position, below the neck.

The invention claimed is:

1. An electric guitar sliding pickup system comprising:

a plastic pickguard on the surface of the guitar extending from a neck to a bridge of the guitar;

a first elongated opening in the plastic pickguard along the entire length of the pickguard with a single guitar pickup therein;

a second elongated opening in the plastic pickguard along the entire length of the pickguard and parallel to the first opening in the plastic pickguard with a slider handle protruding through;

the slider handle attached to the pickup such that when the handle is moved along the length of the second opening, the pickup is moved below the strings along the first opening from the area above the pick guard to the area below the neck a corresponding distance in the same direction, the handle moved by a player's finger in order to manipulate the pickup's position and change the tone of the guitar while simultaneously playing the guitar.

2. The electric guitar sliding pickup system of claim 1 further comprising:

a single volume control with or without a tone control as preferred by a player.

3. The electric guitar sliding pickup system of claim 1, wherein the pickup generates sound at all positions along the pickguard, so that by manipulating the slider handle at different speeds, intervals, and degrees, the player is able to achieve a variety of corresponding sounds and wah wah-like sound effects.

4. The electric guitar sliding pickup system of claim 1, wherein the pickup is attached by the slider handle by a metal rail.

* * * * *